United States Patent [19]

Schwartz et al.

[11] 3,963,154

[45] June 15, 1976

[54] GARMENT HANGER CONSTRUCTION

[75] Inventors: Michel S. Schwartz, Great Neck, N.Y.; William Blasnik, Demarest, N.J.

[73] Assignee: Lerner Manufacturing, Inc., Melville, N.Y.

[22] Filed: Apr. 3, 1975

[21] Appl. No.: 564,957

[52] U.S. Cl. ..... 223/85; 223/88

[51] Int. Cl.[2] ..... A47J 51/098

[58] Field of Search ..... 223/85, 88, 89, 90, 223/91, 92; 211/115; 248/339, 340, 215

[56] References Cited

UNITED STATES PATENTS

| | | | |
|---|---|---|---|
| 2,895,657 | 7/1959 | Laughton | 223/92 |
| 3,069,054 | 12/1962 | Treiman | 223/92 |
| 3,319,850 | 5/1967 | Rosen | 223/92 |

FOREIGN PATENTS OR APPLICATIONS

| | | | |
|---|---|---|---|
| 1,406,613 | 6/1965 | France | 223/88 |

*Primary Examiner*—George H. Krizmanich

*Attorney, Agent, or Firm*—Blum, Moscovitz, Friedman & Kaplan

[57] ABSTRACT

A garment hanger construction wherein a hook is adapted to be releasably secured in a hanger body and adapted to swivel with respect thereto. The hook includes an elongated shaft having projecting flanges substantially intermediate the lengthwise extent of the shaft. The flanges are adapted to be collapsibly flexed toward each other. The hanger body includes bearing loops defining a bearing sleeve for receiving the hook shaft, one of the loops being engaged by at least one of the flanges to rotatably secure the hook in the hanger body.

9 Claims, 8 Drawing Figures

GARMENT HANGER CONSTRUCTION

BACKGROUND OF THE INVENTION

The invention is directed to a garment hanger construction, and in particular to a garment hanger construction having a hook adapted to be releasably secured in a hanger body and able to swivel with respect thereto. Garment hanger constructions wherein a hook is adapted to be rotatably secured to a hanger body have taken various forms. Although such hanger constructions have been developed which allow the hook portion to be releasably secured to the hanger body and additionally pivoted with respect thereto, such hanger constructions have been less than completely satisfactory in view of the lack of structural integrity caused by the manner in which the hook is secured to the hanger body. Accordingly, a hanger construction wherein a hook is releasably and rotatably securable to a hanger body and wherein the manner in which same is secured provides structural rigidity to the hanger construction is desirable.

SUMMARY OF THE INVENTION

Generally speaking, in accordance with the invention, a hanger construction including a hook and hanger body wherein the hook is adapted to be rotatably secured to the hanger body is provided. The hook includes an elongated shaft having projecting flanges substantially intermediate the lengthwise extent of the shaft, the flanges being adapted to be collapsibly flexed together in response to a laterally directed force applied thereto. The hanger body includes a bearing sleeve for receiving the shaft, the bearing sleeve defining a recess for receiving the flanges, a portion of the bearing sleeve defining the recess being engaged by at least one of the flanges to rotatably secure the hook in the bearing sleeve.

Accordingly, it is an object of this invention to provide an improved garment hanger construction wherein a hook is rotatably secured to a hanger body.

Still another object of this invention is to provide an improved garment hanger construction wherein a hook portion is pivotable with respect to the hanger body, and is releasably mounted therewith.

Still a further object of this invention is to provide a garment hanger construction wherein a hook is adapted to be rotatably secured to a hanger body, and wherein the structural integrity of the garment hanger construction is improved.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
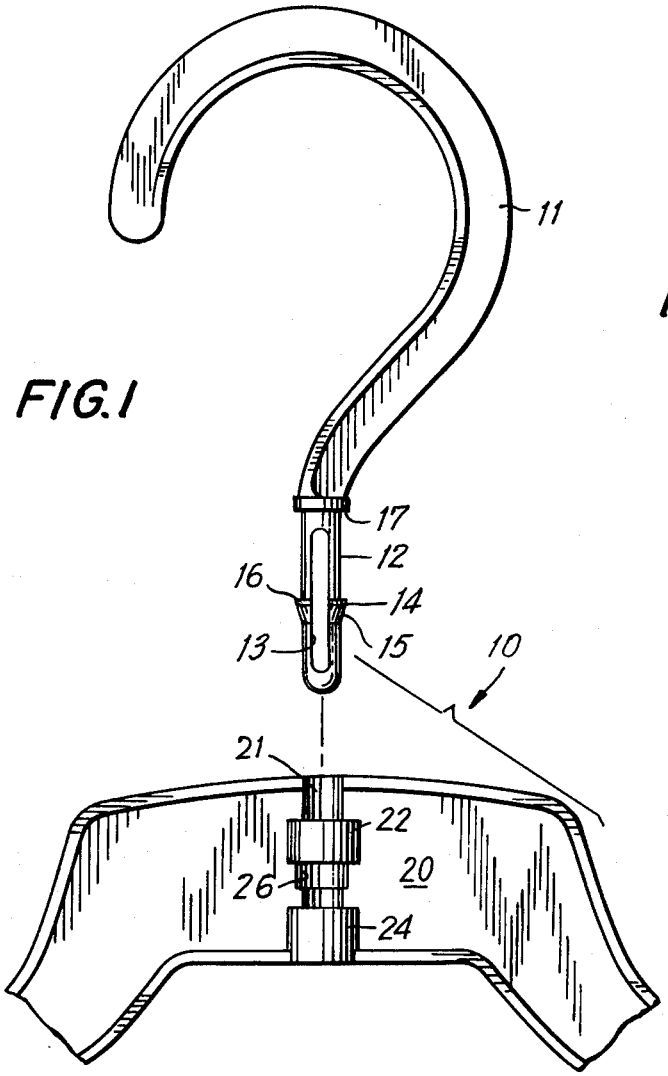
FIG. 1 is a partial exploded elevational view of a hanger construction including a hanger body and hook constructed in accordance with a preferred embodiment of the instant invention.
Figure 3:
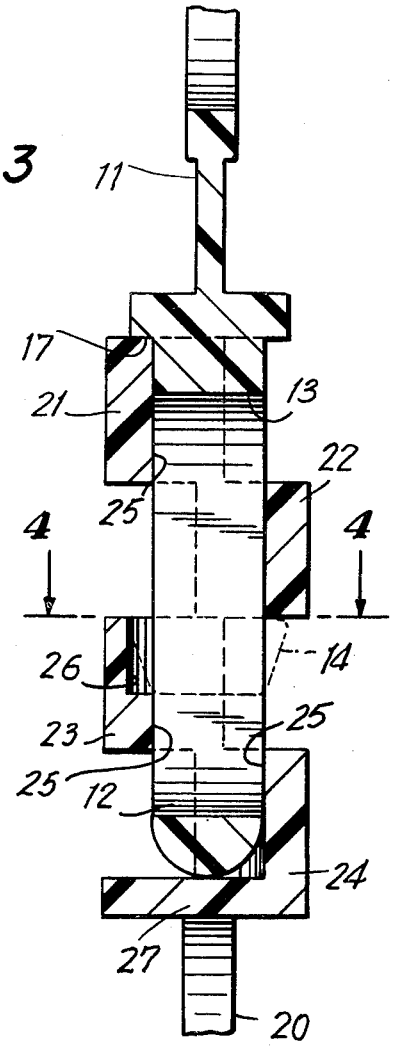
FIG. 3 is a partial sectional view, at an enlarged scale, taken along line 3—3 of FIG. 2.
Figure 2:
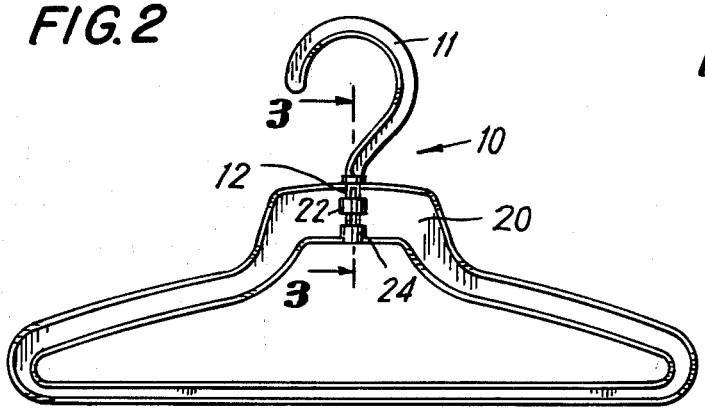
FIG. 2 is an elevational view of the assembled garment hanger construction illustrated in FIG. 1.
Figure 4:
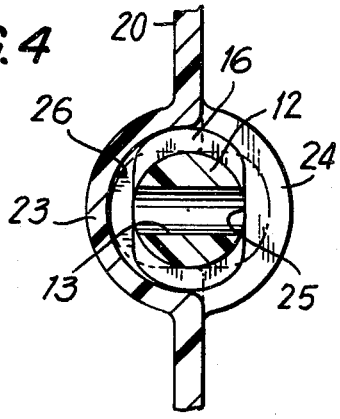
FIG. 4 is a sectional view taken along line 4—4 of FIG. 3.
Figure 5:
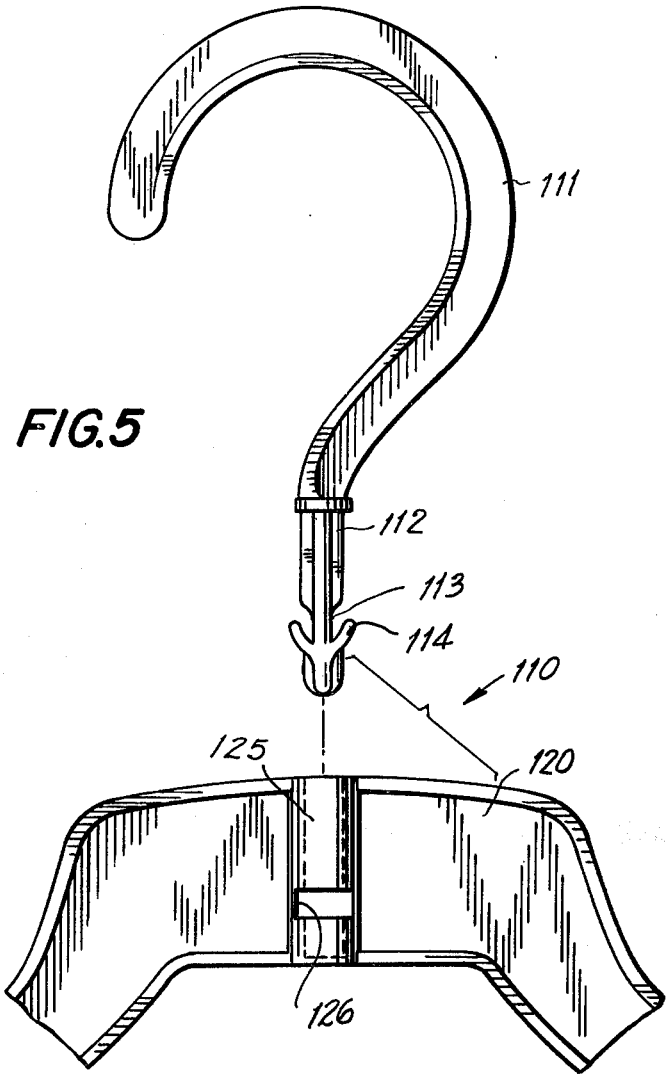
FIG. 5 is a partial exploded elevational view of a hanger construction including a hanger body and hook constructed in accordance with an alternate embodiment of the instant invention.
Figure 7:
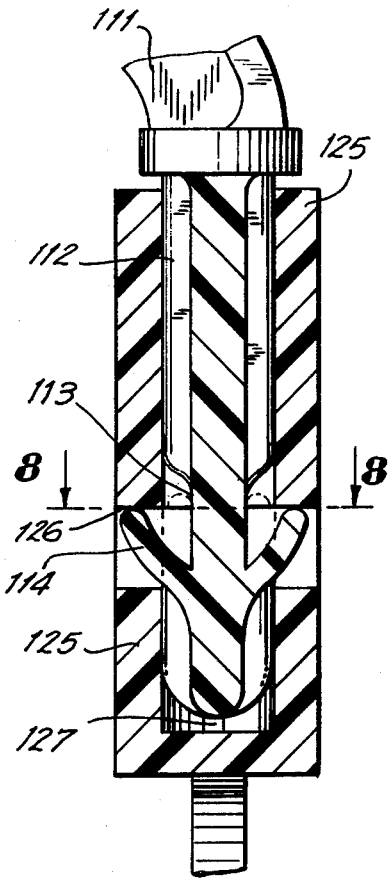
FIG. 7 is a partial sectional view, at an enlarged scale, taken along line 7—7 of FIG. 6.
Figure 6:
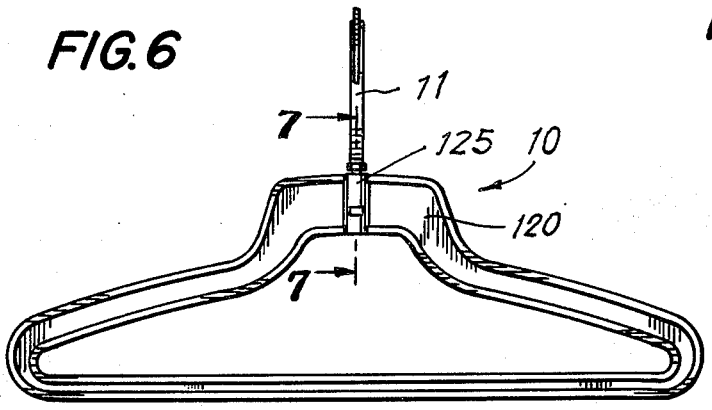
FIG. 6 is an elevational view of the assembled garment hanger construction illustrated in FIG. 5.
Figure 8:
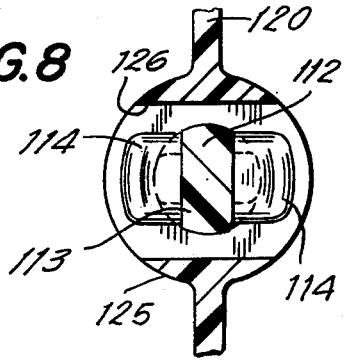
FIG. 8 is a sectional view taken along line 8—8 of FIG. 7.

Reference is now made to FIGS. 1 through 4, wherein a garment hanger construction generally indicated at 10 is depicted. Garment hanger construction 10 is formed of molded plastic and includes a hanger body 20 and a hook 11 adapted to be releasably secured to the hanger body 20 in the manner more fully discussed hereinafter.

Hook 11 includes elongated shaft 12 having a throughhole 13 formed therein. A truncated cone projection 14 is divided into two flanges by through-hole 13. The flanges include an inclined surface 15 and a flat shoulder surface 16.

Hanger body 20 includes substantially semicircular bearing loops 21 through 24 alternately disposed on each side of the hanger body, to define a bearing sleeve 25 adapted to receive the shaft 12 of the hook. Bearing loop 23 includes an annular recess 26 therein, the axial extent of the recess equaling the lengthwise extent of the flanges 14. Bearing loop 24 includes a latitudinal wall 27 adapted to limit the insertion of the shaft 12 into the bearing sleeve 25. It is noted that shaft 12 includes a lateral shoulder 17, contact of the lateral shoulder with bearing loop 21 additionally limiting insertion of shaft 12 into the bearing sleeve.

In operation, the shaft 12 of hook 11 is inserted into bearing sleeve 25 defined by the bearing loops 21 through 25. The inclined surface 15 of the flanges in combination with the through-hole 13 cause the flanges to be collapsibly cammed inwardly until the flanges are brought into alignment with annular recess 26. Once the flanges 14 are aligned with respect to recess 26, the flanges flex outwardly and nest in recess 26, preventing the hook 11 from being released from the hanger body and allowing the hook to be swiveled 360° with respect to the hanger body. Moreover, placement of the bearing loops on the respective sides of the hanger body 20 in alternating fashion, in combination with the elongated shaft of the hook, provides a rigid garment hanger construction. Finally, by applying a lateral force to shaft 12 proximate the elongated through-hole portion, the flanges are flexed inwardly so that the effective diameter of the shaft is reduced, whereupon the hook can be displaced from the hanger body.

It is noted that the annular recess in the bearing loop effects positioning, swiveling and securing of the hook in the hanger body, and that the latitudinal wall 27 and/or lateral shoulder on the shaft are not necessary to effect positioning and securing of the hook in the hanger body.

Reference is now made to FIGS. 5 through 8, wherein a garment hanger construction constructed in accordance with an alternate embodiment of the instant invention is depicted, like reference numerals having 100 added thereto being utilized to denote like elements. Garment construction 110 includes a hanger body 112 adapted to rotatably receive hook 111.

Hook 111 includes an elongated shaft 112 having a cruciform cross-section and including a reduced diameter portion 113 formed therein. The shaft 112 further includes two flexible flanges 114 adapted to be flexed together in response to a lateral forces applied thereto.

Hanger body 120 includes a substantially cylindrical bearing sleeve 125 adapted to receive shaft 112. Bearing sleeve 125 defines through-hole 126 therein, the axial extent of the through-hole corresponding to the lengthwise extent of the flanges 114. Bearing sleeve 125 terminates in an end wall 127 adapted to limit the insertion of the shaft 112 therein.

In operation, the shaft 112 of hook 111 is inserted into bearing sleeve 125. The flanges are collapsibly cammed inwardly as the shaft 112 is inserted into bearing sleeve 125 until flanges 114 are in axial alignment with through-hole 126, whereupon the flanges flex outwardly and nest in the recess defined by the through-hole. Accordingly, the flanges contact the walls defining the through-hole thereby preventing the shaft 112 from being removed from the bearing sleeve and allowing the hook to be swivelled 360° with respect to the hanger body.

It is noted that the use of a reduced diameter shaft for obtaining collapsible flanges can be utilized with the alternating bearing loop arrangement depicted in FIG. 1 embodiment and that a shaft having a through-hole for providing for collapsible flexing of the flanges can be utilized in the bearing sleeve arrangement depicted in FIGS. 5 through 8. Additionally, it is noted that removal of the hook from the hanger can be effected by applying a laterally directed force against the projecting flanges 114 to reduce the effective diameter of the shaft in the same manner as discussed above with respect to the embodiment depicted in FIGS. 1 through 4.

It will thus be seen that the objects set forth above, among those made apparent from the preceding description, are efficiently attained, and since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of lanquage, might be said to fall therebetween.

What is claimed is:

1. A garment hanger construction comprising in combination a hook having an elongated shaft including flexible projecting flanges substantially intermediate the lengthwise extent of said shaft, said flanges being collapsibly flexed together in response to a laterally directed force applied thereto, and a hanger body including a bearing sleeve dimensioned to receive said shaft, said bearing sleeve including recess means disposed intermediate the lengthwise extent of said bearing for nesting said flanges so that portions of said bearing sleeve rotatably secure both lengthwise portions of said elongated shaft adjacent said flanges to thereby journal said elongated shaft in said bearing sleeve.

2. A garment hanger construction as claimed in claim 1, wherein said elongated shaft includes a substantially circular cross-section, and an elongated through-hole proximate said flanges for rendering same collapsibly flexible together.

3. A garment hanger construction as claimed in claim 1, wherein said elongated shaft includes a cruciform cross-section having a reduced cross-section proximate said flanges for rendering same collapsibly flexible together.

4. A garment hanger construction as claimed in claim 1, wherein said bearing sleeve is defined by bearing loops, at least one of said loops including means engagable by at least one of said flanges for rotatably securing said hook in said bearing sleeve.

5. A garment hanger construction as claimed in claim 4, wherein said bearing sleeve includes a bearing loop defining said recess means formed therein for nesting said flange.

6. A garment hanger construction as claimed in claim 5, wherein the cross-section of said bearing recess defined by said bearing loops is substantially circular.

7. A garment hanger construction as claimed in claim 4, wherein said bearing loops defining said bearing sleeve are substantially semi-circular and disposed on opposite sides of said hanger body.

8. A garment hanger construction as claimed in claim 7, wherein said bearing loop defining said recess means is disposed longitudinally on a first side of said hanger body between two additional loops on said other side of said hanger body.

9. A garment hanger construction as claimed in claim 1, wherein a tubular wall defines a cylindrical bearing sleeve, said wall including a lateral opening disposed intermediate the lengthwise extent thereof, said lateral opening defining said recess means for said flanges.

* * * * *